US006905266B2

(12) United States Patent
Fromson et al.

(10) Patent No.: US 6,905,266 B2
(45) **Date of Patent: *Jun. 14, 2005**

(54) WIRE WOUND APPLICATOR FOR DEVELOPING FLUID ON A LITHOGRAPHIC PRINTING PLATE

(75) Inventors: Howard A. Fromson, Stonington, CT (US); William J. Rozell, Vernon, CT (US)

(73) Assignee: Anocoil Corporation, Rockville, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/916,153

(22) Filed: Aug. 11, 2004

(65) Prior Publication Data

US 2005/0013608 A1 Jan. 20, 2005

Related U.S. Application Data

(63) Continuation of application No. 10/446,357, filed on May 28, 2003, now Pat. No. 6,793,418.

(51) Int. Cl.[7] ..... G03D 5/06

(52) U.S. Cl. ..... 396/602; 396/604; 396/606; 396/626; 355/27

(58) Field of Search ..... 396/602, 604, 396/606, 626; 355/27–29, 77; 134/64 P, 64 R, 122 P, 122 R

(56) References Cited

U.S. PATENT DOCUMENTS

| | | | | | |
|---|---|---|---|---|---|
| 4,737,810 | A | * | 4/1988 | Kobayashi et al. | 396/575 |
| 5,210,005 | A | * | 5/1993 | Takekoshi et al. | 396/604 |
| 5,984,539 | A | * | 11/1999 | Patton et al. | 396/604 |
| 6,423,138 | B1 | * | 7/2002 | Piccinino et al. | 118/203 |

FOREIGN PATENT DOCUMENTS

| | | | |
|---|---|---|---|
| DE | 2 163 151 | * | 5/1973 |

* cited by examiner

*Primary Examiner*—D. Rutledge
(74) *Attorney, Agent, or Firm*—Alix, Yale & Ristas, LLP

(57) ABSTRACT

The invention relates to the application of a uniform film of a fluid to the surface of a flat workpiece as it is being conveyed through a workstation. The invention is specifically directed to the development of lithographic printing plates and comprises the application of the thin film of developer solution to each plate in a controlled manner using a wire-wound coating device and a unique manner of metering and feeding fresh fluid to the wire-wound device. Specifically, the fluid is gently fed onto the wire-wound device by simple volumetric displacement and overflow from the inside of a hollow tube onto the wire and the flow is controlled by sensing the beginning and end of each workpiece or plate. The hollow tube may be the wire-wound component or it may be a tube mounted above the wire-wound component. The spent developer is rinsed and sent to waste. According to the invention, only fresh developer solution is applied at a uniform film thickness, thereby achieving uniform image development.

20 Claims, 5 Drawing Sheets

WIRE WOUND APPLICATOR FOR DEVELOPING FLUID ON A LITHOGRAPHIC PRINTING PLATE

This is a continuation of U.S. application Ser. No. 10/1446,357 filed May 28, 2003 now U.S. Pat. No. 6,793, 418, the benefit of which is claimed under 35 U.S.C. Sec. 120.

The present invention is directed to a method and apparatus for applying a uniform film of fluid to a flat surface being conveyed through a workstation and specifically for applying a uniform film of developer to lithographic printing plates in a developing station. The invention is particularly directed to the use of a wire-wound rod for uniformly distributing the fluid over the workpiece and to the technique for metering and delivering the fluid to the wire-wound rod. The present invention is applicable to various planar workpieces and various types of workstations but is particularly applicable to lithographic printing plates which have been imaged and require the application of a developer to remove the areas of the coating on the plate which have been rendered soluble by the imaging process. Although the invention has a broader application, it will be described with particular reference to lithographic printing plate development.

One method for the development of the imaged plates entails the application of a thin film or layer of developing solution to the imaged plate surface of each imaged plate to be developed. This thin film of developer solution is allowed to dwell on the plate for a time sufficient to complete the development and then rinsed from the plate. Because only a thin film of developer solution is applied to each plate, any variation of any part of the surface of the plate from being substantially flat and horizontal and any variation in the thickness of the film of developer and any variation in the dwell time of the developer on different areas of the plate can result in the improper development of the coating.

The use of a wire-wound rod as a coating means is well suited to the continuous coating of web materials with a fluid, and well known in the art. Typically, a wire-wound coating rod is used in a coating method where some volume of fluid is continuously applied to the web surface prior to the rod, and surface. However, the coating of individual, discrete plates requires the ability to precisely initiate the coating process and precisely terminate the coating process on individual plates delivered at irregular intervals. In the case of lithographic printing plates, the developer fluid must be applied in the correct amount uniformly distributed across the width and length of the plate, with minimal waste.

The use of a wire-wound rod in metering the developer in a lithographic plate processor is known in the art. U.S. Pat. No. 4,737,810 teaches the application of excess developer with the wire-wound rod serving as the means to meter off the excess into some recovery means. The rod thus serves as the means to control the volume of fluid consumed in the development process. The developer fluid is applied to the plate ahead of the wire-wound rod and it is indicated in this patent that the path between the delivery of the fluid and the metering at the wire-wound rod is sufficiently short that development does not commence within this area. The excess developer removed in this area is intended to be reused.

Typical imaging methods include exposure to radiation and writing by ink jet. As is well known in the art, the imaging process renders the coating soluble in the imaged areas of a positive-working plate and renders the coating insoluble in the imaged areas of a negative-working plate. In either case, it is the coating which has been rendered soluble or the coating which has remained soluble that is removed. The particular compositions of the developer solutions for these different types of printing plates are well known. For example, many of the printing plates currently in use are positive-working plates and have coatings that contain alkali-soluble resins, specifically phenolic or acrylic resins. These coatings usually contain dissolution inhibitors that render them insoluble in the alkaline developers. The imaging process reverses this dissolution inhibition and the coating then becomes soluble in the areas subjected to the imaging radiation.

Excess developer that has been applied to the surface, metered off by a wire-wound rod, and subsequently recovered has been exposed to the atmosphere, and as such is subject to degradation. It is well documented in the art that atmospheric carbon dioxide rapidly reduces the alkalinity of aqueous alkaline developers of the type very commonly used in the processing of positive-working plates. Thus the recovered developer that is being reused will not have the same alkalinity as fresh, new developer. This recovered developer is in fact therefore reused in a way that with each application of developer to the plate, some fraction of the developer metered off by the wire-wound coating rod will have been removed in a previous cycle of development. Thus the repeated exposure to carbon dioxide and resultant degradation will further alter the effective alkalinity of the developer. Further, if the developer is applied some distance ahead of a wire-wound rod, some degree of development is certain to take place and it may very well be uneven.

With positive-working plates, the difference in the solubility of the imaged and non-imaged areas of the coating is generally less than the difference in solubility for negative-working plates. For that reason, the development process is more critical for positive-working plates. Also, the development mechanism for positive-working plates is a percolation process and a quiescent film of developer solution is critical. Any relative movement between the developer and the surface of the plate must be minimized or eliminated. Furthermore, the film of developer must be uniform with no bubbles. For these reasons, it is critical how the developer is applied to the plate.

SUMMARY OF THE INVENTION

The present invention is directed to an apparatus and a method for applying a uniform film of a fluid to the surface of a flat workpiece as it is being conveyed through a workstation. The invention is specifically directed to the development of lithographic printing plates and comprises a novel system and method for applying the thin film of developer solution to each plate in a controlled manner using a wire-wound rod coating device and a unique manner of metering and feeding fresh fluid to the wire-wound rod. Specifically, the fluid is gently fed onto the wire-wound rod by simple volumetric displacement and overflow and the flow is controlled by sensing the beginning and end of each workpiece or plate. The developer is allowed to dwell on the plate as it is conveyed across a platen or other support structure for a sufficient time to allow for percolation into and/or dissolution of the soluble areas of the coating. The spent developer is rinsed and sent to waste. According to the invention, only fresh developer solution is applied at a uniform film thickness, thereby achieving uniform image development.

DESCRIPTION OF THE PREFERRED EMBODIMENTS

Figure 1:
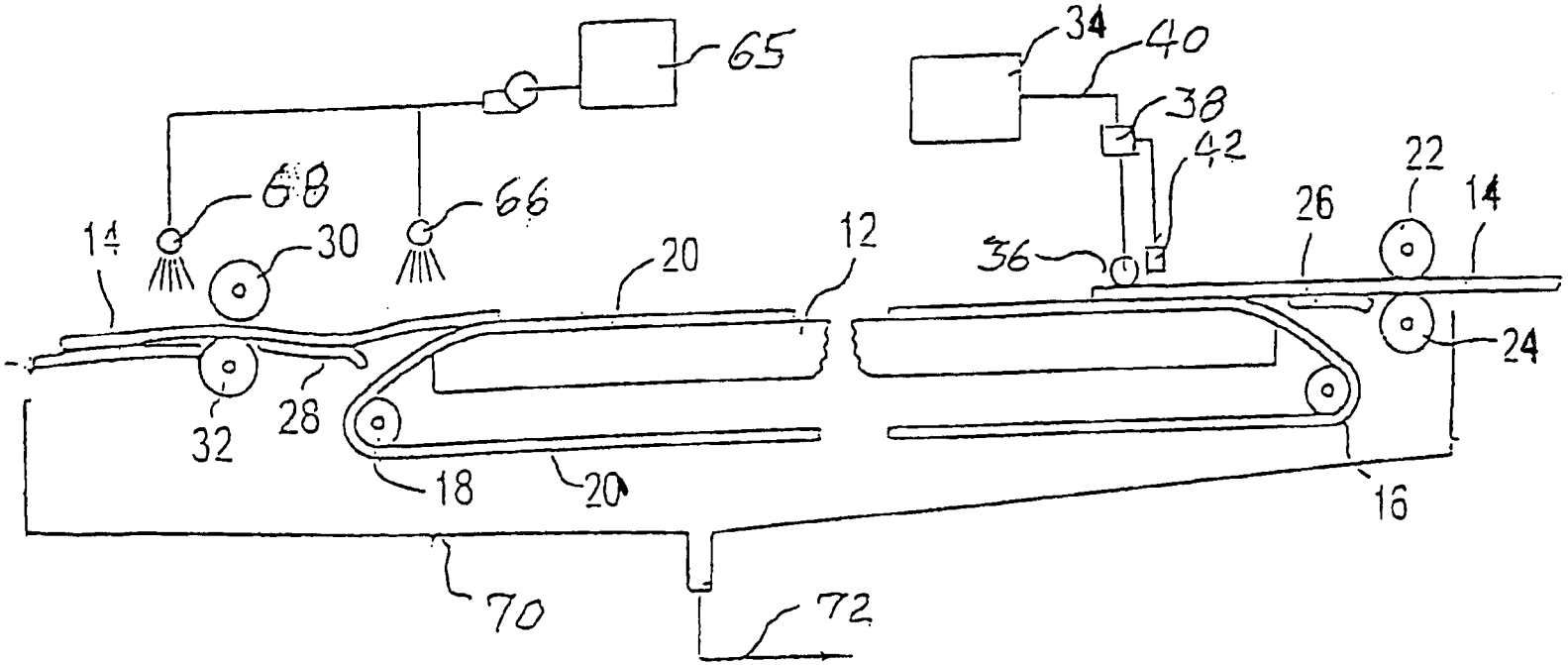
FIG. 1 is a general diagrammatic sketch of a coating apparatus, specifically a lithographic printing plate developer, incorporating the novel method and apparatus for the present invention for applying a uniform film of fluid to a moving flat surface.

FIG. 1 is a diagrammatic drawing illustrating the general arrangement for practicing the invention illustrating the equipment and method for developing an imaged lithographic printing plate. The developer apparatus comprises a substantially horizontal support structure which is preferably a platen 12 which may be any flat, horizontal surface composed of materials which will be unaffected by the particular developer solution to be used. In the context of the present invention and as used herein, the terms substantially flat and or substantially horizontal are defined as deviating from flat and/or horizontal only to the degree that the developer solution applied to the plate does not flow over or off of the surface of the plate. That is, the developer solution will remain as a film on the plate and have a thickness that produces uniform development over the entire area of the plate. The printing plate 14, which has been exposed and thus imaged, is carried across the platen 12 by means of a conveyor which comprises the conveyor drive rollers 16 and 18 and a continuous flexible conveyor belt 20. The conveyor belt 20 is composed of a material which will be unaffected by the developer solution, such as stainless steel or a polymer material. The printing plate 14 is fed by the feed rollers 22 and 24 onto the feed platform 26 which directs the printing plate onto the conveyor belt 20 for transport across the platen 12. After processing, the printing plate is guided by the discharge platform 28 into a pair of discharge rollers 30 and 32. Although the flat platen is the preferred support structure, other supports can be employed for the conveyor belt. For example, the support structure could be a series of rollers which have a small diameter and are closely spaced such that they provide adequate support to maintain a flat plate. Also, although the drawing depicts a conveyor belt for conveying the plate across the support structure, other conveying means could be employed. Merely as one example, the plate can initially be conveyed across a support structure such as a platen by the feed rollers for the plate and it can then be further conveyed the remaining distance directly by small driven rollers.

In the present invention, a novel design of a wire-wound rod coating system including means for metering and feeding the developer solution to the rod is used to control the thickness and assure the uniformity of the developer solution on the plate. In contrast to the known techniques where an excess of fluid is applied and subsequently metered off by the wire-wound rod, the present invention delivers precisely the required volume of developer at precisely the rate required to obtain a uniform film of developer on the plate in the amount needed to process the plate with very little excess. The preferred means for controlling the volume of developer delivered and the rate at which it is delivered is a peristaltic pump. The delivery of the developer is commenced at the beginning of the plate and continues at the appropriate rate of flow until the end of the plate where it is stopped. The wire-wound rod in the present invention is merely a means for ensuring the uniform distribution of the developer across the surface of the plate since there is little if any excess developer to be removed. Thus all problems with developer degradation that arise from the recirculation of excess developer are eliminated.

In the context of the present invention, the term "wire-wound" includes what are termed "formed rods". These formed rods are manufactured by machining a rod or tube to produce a rolled thread-like profile that duplicates the pitch and radius of the rods formed by winding wire and are to be understood to be the equivalent of rods formed by winding wire onto a core. In one embodiment, a wire-wound coating rod is fabricated using a hollow tube as the core on which the wire is wound. The developer is delivered to the interior of the tube. There are penetrations through the wall of the tube allowing the developer to flow out from the interior. There are two main alternatives for this rod embodiment. In one alternative, the wire is tightly wound around the circumference of the rod, i.e., there are no gaps between adjacent winds. In this alternative, it is necessary to provide some means for the fluid to flow through the wire. This can be accomplished by drilling holes at a series of locations between adjacent wraps of the wire. The drilling may be any means of providing holes including direct mechanical drills or the use of laser beams to remove material and form a hole. In this embodiment, the hollow tube that serves as the core of the rod may be provided with slots or holes prior to being wound with wire. The holes between the wraps of the wire are subsequently drilled at locations corresponding to the positions of the holes or slots in the tube. Alternatively, a hollow tube with no slots or holes may be wound with wire, and the subsequent drilling of the holes between the wire wraps may be done such the penetration through the hollow tube is made during this drilling process.

In the second alternative, the wire is loosely wound around the hollow tube, i.e., the helical pitch of the winding exceeds the diameter of the wire, resulting in a gap between adjacent winds. For example, if a wire with a 0.010" (10 mils) diameter is wound on a helical pitch of 0.011", there will be a gap of 0.001" between adjacent wraps. The gaps allow for the liquid to flow out between the wires. The hollow tube is preferably provided with slots or holes prior to the winding, but the drilling of holes in the tube in the gaps between the wire after winding is possible.

The holes or slots provided are distributed along the length of the tube to enable the developer to be spread uniformly across the width of the plate. The tube is filled with the fluid to the level of the holes or slots. The small openings in the tube inhibit the exchange of air into the interior of the tube. This is an important advantage when using alkaline developers that are subject to degradation by atmospheric carbon dioxide.

In a preferred embodiment, a peristaltic pump is used as the means for delivering the developer to the interior of the hollow tube. The pump commences operation when the leading edge of the plate is detected by a sensor. The volume of developer delivered by the peristaltic pump causes an equal volume of developer to overflow through the slots or holes out onto the wire, where it is distributed across the plate width. The pump rate is matched to the plate speed and developer quantity requirement to maintain a uniform coverage along the length of the plate. The pump stops in conjunction with the sensing of the trailing edge of the plate. In FIG. 1, this is diagrammatically illustrated by the developer supply drum 34, the wire-wound rod 36, the developer pump 38, the developer feed line 40 and the plate sensor 42 such as a photoelectric sensor.

Figure 2:
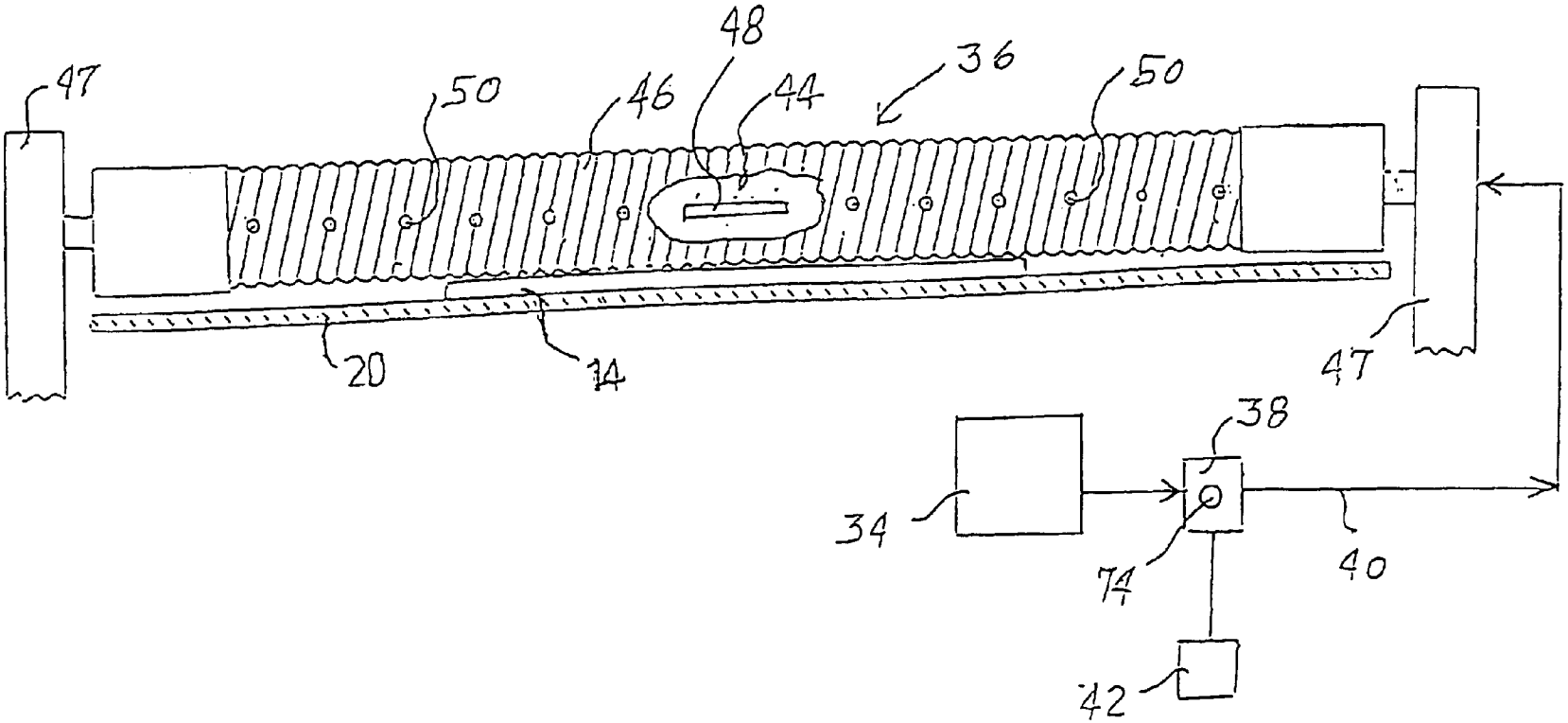
FIG. 2 illustrates one embodiment of the use of a wire-wound rod and fluid delivery means for applying the fluid to the surface.

FIG. 2 shows one embodiment of a wire-wound rod and the means for metering and feeding the developer to the wire-wound rod according to the present invention. The rod itself actually comprises a hollow tube 44 with the wire 46 being spirally wound around the tube. The tube is mounted for limited vertical movement in the frame members 47 but it is mounted so as to prevent rotation. Located along one side of the tube 44 are slots 48 extending through to the inside of the tube. Although only one slot 48 is shown in FIG. 2 through the cutaway opening in the wire 46, a series of slots are lined up along the side of the tube which faces upstream with respect to the direction of travel of the plate. Merely as an example, these slots may be 1/16 inch wide by ½ inch long with 1 inch between slots. Small holes 50 are formed through the layer of wire between adjacent wraps of the wire with these holes lining up with the slots 48. The developer is fed to the inside of the tube 44 from the supply drum 34 through the flexible tube 40 which goes through the preferred peristaltic pump 38. The pump is switched on and off by the plate sensor 42. The developer exits through the slots 48 and holes 50 and runs down over the wire-wound rod onto the plate 14. In general, the thickness of the fluid applied is equal to about 9% or 10% of the diameter of the wire on the rod.

Figure 3:
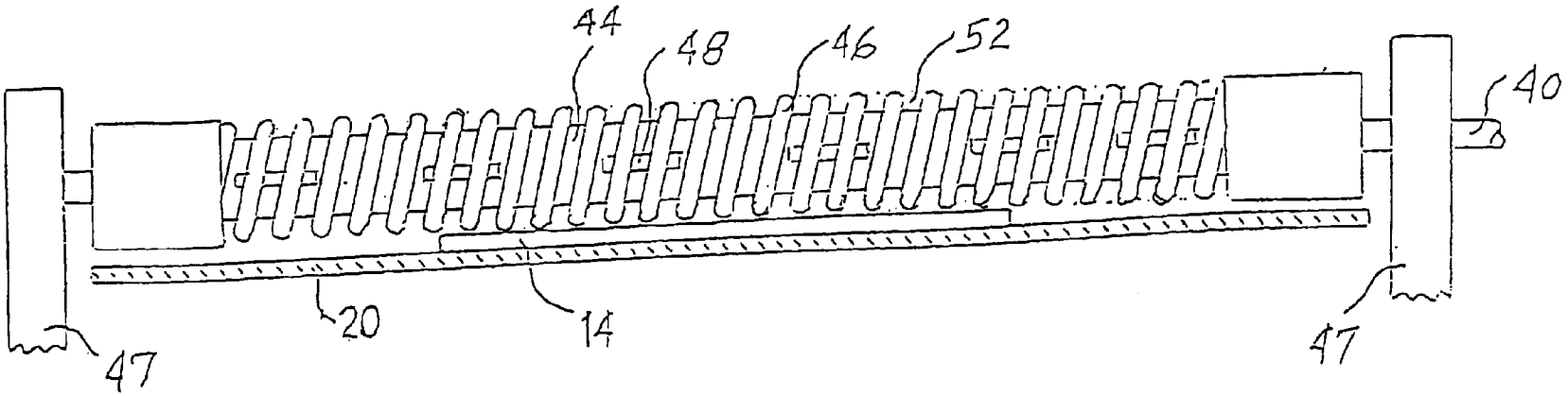
FIG. 3 illustrates a second embodiment of the wire-wound rod.

Another embodiment of the wire-wound rod of the present invention is shown in FIG. 3. The tube 44 still has the slots 48 but the spirally wound wire 46 is now loosely wound with gaps 52 between adjacent winds. These gaps permit the fluid to flow out from the slots 48 between the wires. The relative sizes of the wire and gap are distorted in this FIG. 3 for clarity from what would typically be employed. As an example, the wire might be on the order of 0.010 inches (10 mils) in diameter while the gap might be on the order of 0.001 inches wide. The gap needs to be just wide enough to permit the fluid to flow through at the necessary rate.

Figure 4:
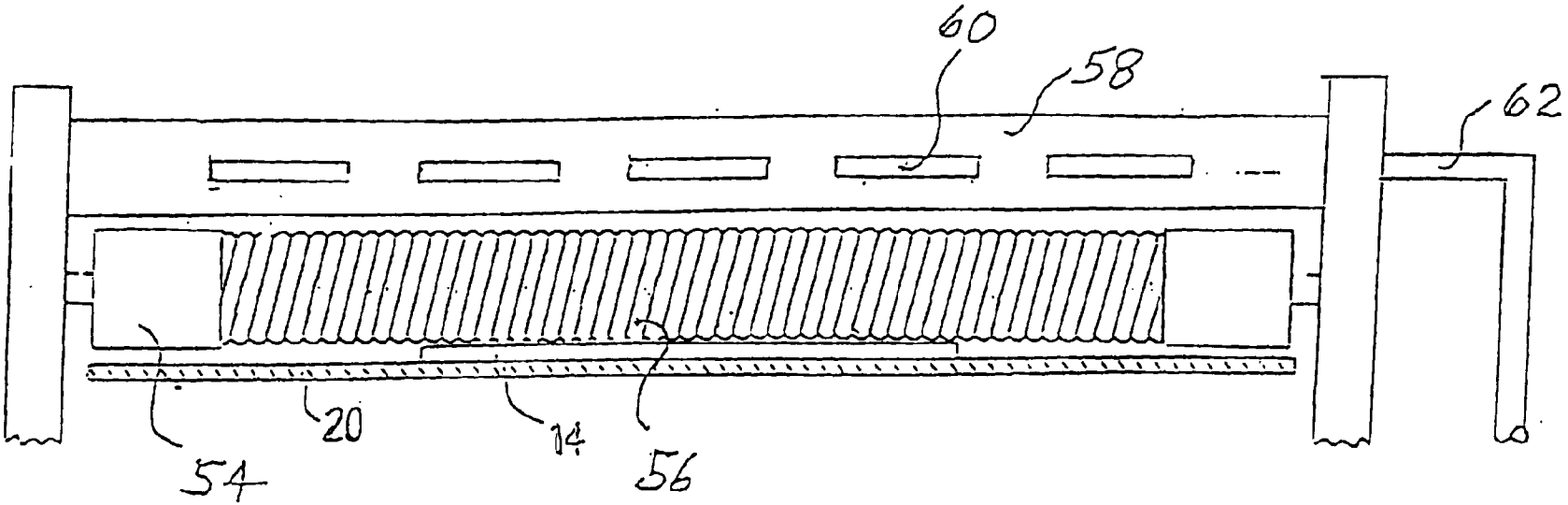
FIG. 4 illustrates a further embodiment for delivering the fluid to the wire-wound rod.
Figure 5:
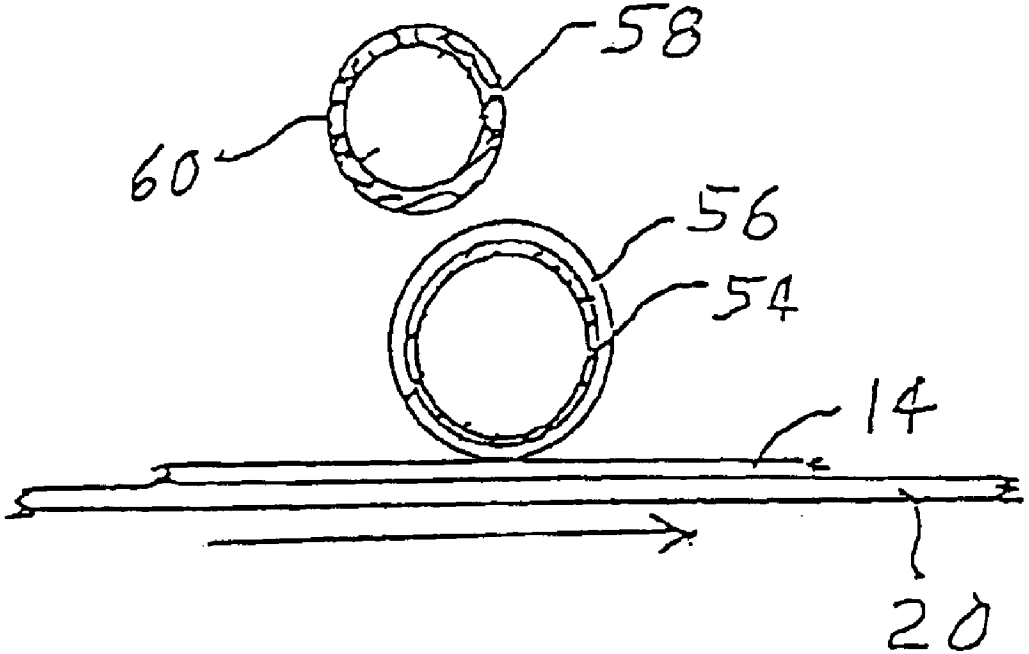
FIG. 5 is a cross section of the wire-wound rod and fluid delivery tube of FIG. 4.

A further embodiment of the invention is shown in FIGS. 4 and 5. In this embodiment, the fluid feeding tube is separate from the rod on which the wire is wound. The rod 54 is a typical wire-wound rod containing a core, which can be solid, and wound with the wire 56. Once again, the rod 54 is mounted in the frame 47 but in this case the rod 54 can be mounted to rotate if desired. In applications where the fluid is a low viscosity fluid and the film thickness is small, it is particularly advantageous to match the circumferential surface speed of the wire-wound rod to the conveyor belt speed to reduce any tendency of the wire-wound rod to scratch the surface of the plate. In this embodiment, a fluid supply tube 58 is mounted above the rod 54. This fluid supply tube, which may be cylindrical as illustrated or any other desired cross-sectional configuration, is provided with the slots 60 similar in function to the slots 48 in FIGS. 2 and 3. The fluid is supplied to the fluid supply tube 58 through the feed line 62. The fluid supply tube is mounted above the rod 54 such that the fluid will run down the fluid supply tube and flow onto the wire 56 on the rod 54 on the upstream side of the rod 54. This is shown in FIG. 5 where the arrow 64 shows the direction of movement of the conveyor and plate and the tube 58 is located slightly upstream from the rod 54. This assures that all of the fluid fed onto the plate is subjected to the action of the wire-wound rod and not run down onto the plate on the downstream side of the rod.

The printing plate which has been coated with the developer solution continues to travel across the platen. The length and speed of travel is selected such that the developer solution will have completed the development process by the time the printing plate reaches the discharge end of the platen. A typical development time is 20 to 60 seconds. At this point, rinse water from the supply 65 is sprayed onto the plate through the spray nozzles 66 and 68. Located below the conveyor structure is a collection pan 70 which collects all of the liquid run off from the printing plate including the spent developer solution and rinse water now containing the portion of the coating which has been dissolved away. The developer solution which is rinsed from the plate is collected at 72 and sent to waste. It can be seen that there is always only fresh developer solution being applied to the plates and that there is only a small quantity of developer solution applied to each plate. It has been discovered that the consumption of developer solution can be reduced by as much as 50% when compared to a conventional printing plate development processor.

In order to properly develop an imaged plate in accordance with the present invention, it is essential that the thin film of developer solution be substantially uniformly distributed over the entire upper, imaged surface of the plate as it is being conveyed across the platen. This requires that the plate on the conveyor be substantially flat and substantially horizontal or level and begins with having a substantially flat, horizontal support structure and, therefore, a substantially flat horizontal conveyor belt. Since the printing plates are very thin and flexible, surface tension is used to hold the plate firmly in position and flat on the conveyor belt. For example, this can be done by providing a film of water between the plate and the conveyor belt.

The present invention uses simple volumetric displacement and overflow as the means for controlling the rate and volume of fluid applied to the plate. Referring back to FIGS. 1 and 2, the pump 38 commences when the leading edge of the plate is detected by the sensor 42. The volume of fluid delivered by the pump is adjusted by the speed control dial which is matched to the plate speed and quantity of fluid required to maintain a uniform coverage along the length of the plate. The volume of fluid delivered by the pump causes an equal volume of fluid to overflow through the slots or holes out onto the wire. The pump stops as a function of the sensing of the trailing end of the plate. Although other low pressure pumps could be used, the preferred pump is a peristaltic pump which offers good control of volume and flow rate. Also, there is rapid response to switching the flow on and off. The fluid only comes in contact with the tubing so chemically aggressive fluids can be accommodated. Further, the gentle pumping action reduces problems with foaming that can occur with pressurized systems. A uniform film of fluid is gently applied to the plate without bubbles to produce a quiescent film suitable for uniformly developing printing plates. Another method of feeding the fluid is by gravity flow from a raised reservoir including level control means to maintain a constant head in the reservoir. A valve in the feed line from the reservoir is triggered by the detection of the leading and trailing ends of the plate by the sensor. This embodiment is also represented in FIG. 1 when the supply drum 34 is a gravity feed reservoir and the item numbered 38 is the control valve. As a further feature of the invention, the fluid is applied to the plate and coincidentally uniformly spread over the plate at the required thickness. This contrasts sharply with prior art arrangements where the fluid is applied to the plate some distance ahead of the wire-wound rod.

The following examples compare the plates which are developed according to the prior art and plates which are developed according to the present invention. These examples clearly show a significant and unanticipated benefit of the invention.

EXAMPLE 1

Prior Art

An 830 plate commercially available from Anocoil Corporation, Rockville, Conn., which is a plate thermally imaged by infrared radiation, was imaged on a Creo/Scitex Trendsetter Imager, commercially available from Creo/Scitex, Vancouver, British Columbia, Canada. The plate was imaged at an exposure of 200 mj/cm$^2$. The image comprised halftone target areas at a 175 line per inch ruling.

The imaged plate was developed in a Glunz and Jensen Model 135 Plate Processor, commercially available from Glunz and Jensen, Elkwood, Va. The developer used was T-4 Developer commercially available from Anocoil Corporation, Rockville, Conn., which is an aqueous sodium metasilicate solution. This processor immerses the plate in a sump of developer that is recirculated during use and replenished at a rate based on usage.

EXAMPLE 2

Invention

A processor was constructed as depicted in FIG. 1. A wire-wound coating rod was positioned at the entry end of the continuous conveyor belt.

The wire-wound coating rod was constructed according to the depiction shown in FIG. 3. The core was 1¼" stainless steel tube. Slots ½" in length and 1/16" in height were cut along the length of the tube at 1" intervals. The tube was subsequently wound with 0.020" stainless steel wire. The wire was wound at a helical pitch of 0.021", giving a 0.001" gap between adjacent winds on the tube. The tube was placed in the processor on the continuous conveyor belt so that the axis of the tube was perpendicular to the direction of travel of the belt and the orientation of the slots was toward the plate entry end of the processor. One end of the tube was capped and the other end was fitted with a flexible tubing connection. The wire-wound tube was connected to a variable flow peristaltic pump available from VWR International of Bridgeport, N.J.

An 830 T plate was imaged in the same manner as in the Example 1.

The imaged plate was processed in the processor of the present invention using a developer comprising an aqueous sodium metasilicate solution.

A summary of the measured halftone dot values is given in Table 1. The area of interest on the plates was a series of vertical targets of different halftone values. These target values going from left to right across the plate were 50%, 30%, 10%, 70%, 10%, 30% and 50%. It is clear that the Example 2 plate of the present invention has dot values that are much closer to the nominal target values. More significantly, the halftone dot values for the Example 2 plate are more consistent on the left and right sides of the plate than for Example 1. The 50% target values are 45% left and 46% right for the plate processed according to the method of present invention. By contrast, Example 1 shows a very large variation in the 50% target values; 39% left and 19% right. It is clear that the method of the present invention yields a more uniformly processed plate than the prior art method which is typically used commercially.

TABLE 1

| Halftone target dot value | 50% | 30% | 10% | 70% | 10% | 30% | 50% |
|---|---|---|---|---|---|---|---|
| Location on plate | left | left | left | center | right | right | right |
| Example 1 measured dot value | 39.0% | 9.5% | 0.0% | 65.0% | 0.0% | 0.0% | 19.0% |
| Example 2 measured dot value | 45.0% | 26.0% | 8.0% | 67.0% | 8.5% | 25.5% | 46.0% |

What is claimed is:

1. Apparatus for developing a lithographic printing plate having an imaged coating on a surface thereof comprising areas of coating insoluble in a selected developer solution and areas of coating soluble in said selected developer solution, said apparatus adapted to remove said soluble coating from said plate and comprising means for conveying said plate across a substantially horizontal support structure, means for applying fresh developer solution to said imaged coating on said surface for a period of time necessary for said soluble coating to dissolve in said developer solution and produce a spent developer solution and a developed plate, and means for removing said spent developer solution from said developed plate and discharging said spent developer solution to waste wherein said means for applying fresh developer solution comprises:

a. a wire-wound rod for applying developer solution to said plate as the plate is being conveyed b. a support member for maintaining the wire rod in a horizontal position above the means for conveying the plate;

c. a horizontal hollow tube having a plurality of apertures along the length on one side thereof, said tube being mounted above said wire wound rod; and d. means for feeding fresh developer solution into said tube whereby said developer solution overflows from said tube through said plurality of apertures and flows down said tube onto said wire wound rod, to produce a uniform thickness of fresh developer film over the entire plate.

2. Apparatus as recited in claim 1 wherein said means for feeding a developer solution into said hollow tube comprises a pump.

3. Apparatus as recited in claim 2 wherein said pump is a peristaltic pump.

4. Apparatus as recited in claim 1 wherein said means for feeding a developer solution into said hollow tube comprises a gravity feed system.

5. Apparatus as recited in claim 1 and further including means for sensing the presence of a plate and controlling said means for feeding developer solution so that said solution flows down said tube onto said wire wound rod only when a plate is substantially under said rod.

6. Apparatus for applying a fluid to a lithographic printing plate, said apparatus comprising means for conveying said plate across a substantially horizontal support structure and a rod device for applying a fluid to said plate as it is being conveyed wherein the rod device comprises:

a. a horizontal wire wound rod;

b. a horizontal hollow tube having a plurality of apertures along the length on one side thereof, said tube being mounted above said wire wound rod; and c. means for feeding a fluid into said tube whereby said fluid overflows from said tube through said plurality of apertures and flows down said tube onto said wire wound rod, such that fluid is transferred from the rod to the plate to produce a uniform thickness of fluid over the entire plate.

7. Apparatus as recited in claim 6 wherein said means for feeding a fluid into said hollow tube comprises a pump.

8. Apparatus as recited in claim 7 wherein said pump is a peristaltic pump.

9. Apparatus as recited in claim 6 wherein said means for feeding a fluid into said hollow tube comprises a gravity feed system.

10. Apparatus as recited in claim 6 and further including means for sensing the presence of a plate and controlling said means for feeding a fluid so that said fluid flows down said tube onto said wire wound rod only when a plate is substantially under said rod.

11. A method of developing a lithographic printing plate having an imaged coating comprising areas of coating soluble in a developer solution, said method adapted to remove said soluble coating from said plate and comprising the steps of conveying said plate along a path across a substantially horizontal support structure and applying developer solution to said plate to produce a developed plate and spent developer solution wherein said step of applying developer solution comprises:

a. mounting a horizontal cylindrical wire-wound member across said path;

b. mounting a horizontal hollow tube having a plurality of apertures along the length on one side thereof above said wire-wound member; and c. feeding developer solution into said tube and thereby overflowing said developer solution from said tube through said plurality of apertures whereby said developer solution flows down said tube onto said wire-wound member and from said wire wound member onto said plate.

12. A method as recited in claim 11 and further comprising the step of removing said spent developer solution from said developed plate.

13. A method as recited in claim 12 wherein said step of removing said spent developer solution comprises rinsing said developed plate with water.

14. A method as recited in claim 11 and further including detecting the leading and trailing ends of said plate and controlling said feeding of developer solution in response thereto.

15. A method as recited in claim 11 wherein said step of feeding developer solution comprises pumping said developer solution with a volumetric displacement pump.

16. Apparatus for developing a lithographic printing plate having an imaged coating on a surface thereof comprising areas of coating insoluble in a selected developer solution and areas of coating soluble in said selected developer solution, said apparatus adapted to remove said soluble coating from said plate and comprising means for conveying said plate in a conveyance direction across a substantially horizontal support structure, means for applying developer solution to said imaged coating on said surface for a period of time necessary for said soluble coating to dissolve in said developer solution and produce a spent developer solution and a developed plate, and means for removing said spent developer solution from said developed plate and discharging said spent developer solution to waste wherein said means for applying developer solution comprises:

a. a freely rotatable wire wound rod having a working length and an axis extending horizontally across the conveying direction of said plates such that the conveyed plates will pass under the rod transversely to the rod axis along the working length of the rod; and b. a developer supply system for feeding fresh developer solution at a uniform flow rate along the working length of the rod, whereby fresh developer solution is transferred from the rod to the plate as the rod rotates on said plate, to produce a uniform thickness of fresh developer film over the entire plate.

17. The apparatus of claim 16, wherein the means for conveying is an endless belt traversing a substantially flat platen, and the wire wound rod rests on and is rotated by said belt, such that the plate and rod have the same velocity and direction as the plate passes under the rod to receive the flow of developer solution.

18. The apparatus of claim 16, wherein the developer supply system includes a tube associated with the wire wound rod, means for supplying fresh developer solution to the tube, and slot means in the tube for developer solution to flow out of the tube onto the wire wound rod.

19. The apparatus of claim 17, wherein the developer supply system includes a tube associated with the wire wound rod, means for supplying fresh developer solution to the tube, and slot means in the tube for developer solution to flow out of the tube onto the wire wound rod.

20. Apparatus for developing a lithographic printing plate having an imaged coating on a surface thereof comprising areas of coating insoluble in a selected developer solution and areas of coating soluble in said selected developer solution, said apparatus adapted to remove said soluble coating from said plate and comprising means for conveying said plate across a substantially horizontal support structure, means for applying fresh developer solution to said imaged coating on said surface for a period of time necessary for said soluble coating to dissolve in said developer solution and produce a spent developer solution and a developed plate, and means for removing said spent developer solution from said developed plate and discharging said spent developer solution to waste wherein said means for applying developer solution comprises a wire-wound rod device comprising:

a. a wire wound rod supported horizontally for free rotation;

b. a horizontal hollow tube having a plurality of apertures along the length on one side thereof, said tube being mounted in parallel above said wire wound rod;

d. means for feeding developer solution into said tube whereby said developer solution overflows from said tube through said plurality of apertures and flows down said tube onto said wire wound rod for application of developer onto said plate as said wire wound rod rotates on said plate, whereby a uniform thickness of fresh developer is applied over the entire plate; and e. means for sensing the presence of a plate and controlling said means for feeding developer solution in response to the position of said plate relative to the wire wound rod.

* * * * *